US005383805A

United States Patent [19]

Tsai

[11] Patent Number: 5,383,805

[45] Date of Patent: Jan. 24, 1995

[54] TOY GLIDER WITH ADJUSTABLE FLYING PATH

[76] Inventor: Tzu-Jan J. Tsai, c/o Hung Hsing Patent Service Center P.O. Box 55-1670, Taipei, Taiwan, Prov. of China

[21] Appl. No.: 246,495

[22] Filed: May 20, 1994

[51] Int. Cl.[6] ..... A63H 27/00

[52] U.S. Cl. ..... 446/66; 446/68

[58] Field of Search ..... 446/66, 68, 63–65, 446/61

[56] References Cited

U.S. PATENT DOCUMENTS 2,599,957 6/1952 Walker ..... 446/68

3,091,889 6/1963 Zaic ..... 446/66

3,157,960 11/1964 Schutz et al. ..... 446/63

3,995,393 12/1976 Patterson ..... 446/66

*Primary Examiner*—Mickey Yu

[57] ABSTRACT

A toy glider includes: a fuselage, a telescopic nose member telescopically secured in a front portion of the fuselage for adjusting a gravity center of the glider in order to adjust a flying path such as a curvature radius when arcuately launched, and a self-biasing elevator attached to a tail portion of the fuselage for an automatic upward swinging of the elevator for automatically converting a horizontal flying to an upwardly climbing, thereby enabling an adjustment of a flying path of the glider for enriching a player's interest.

8 Claims, 5 Drawing Sheets

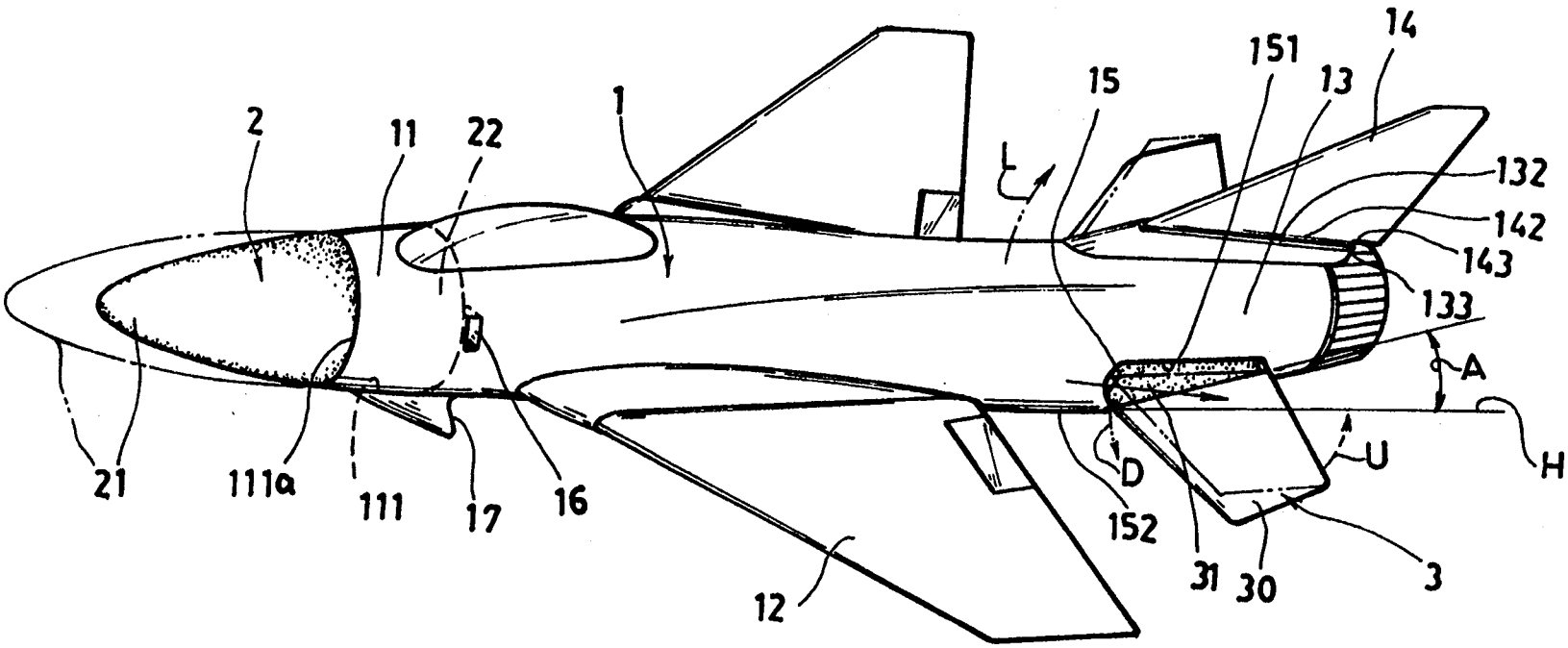
FIG.2
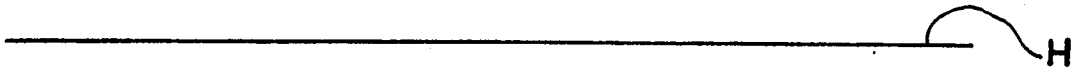

TOY GLIDER WITH ADJUSTABLE FLYING PATH

BACKGROUND OF THE INVENTION

U.S. Pat. No. 5,013,277 to Gerald R. Hufeld disclosed an aerial toy which can be converted to be a toy glider by detachably securing a delta wing to the spine. Such a conventional toy glider includes a counterweight 25 formed on a front end portion of the body 15. Since the counterweight 25 has a fixed weight, it can not be free adjusted for varying a flying path or spinning curvature when catapulted.

A conventional glider G as shown in FIG. 7 has an elevator E provided on a rear portion of the glider body having fixed elevating angle on the elevator E, whereby upon thrusting of the glider under an air flow Air, the glider will be lifted (L) and be immediately launched upwardly along a curvature C4, being unable to have a horizontal sliding movement to simulate a take-off of a real airplane to thereby possibly lose a player's interest.

SUMMARY OF THE INVENTION

The object of the present invention is to provide a toy glider including: a fuselage, a telescopic nose member telescopically secured in a front portion of the fuselage for adjusting a center of gravity of the glider in order to adjust a flying path such as a curvature radius when arcuately launched, and a self-biasing elevator attached to a tail portion of the fuselage for an automatic upward swinging of the elevator for automatically converting a horizontal flying to an upwardly climbing, thereby enabling an adjustment of a flying path of the glider for enriching a player's interest.

BRIEF DESCRIPTION OF THE DRAWINGS

FIG. 2 is a perspective view of the present invention.

DETAILED DESCRIPTION

Figure 1:
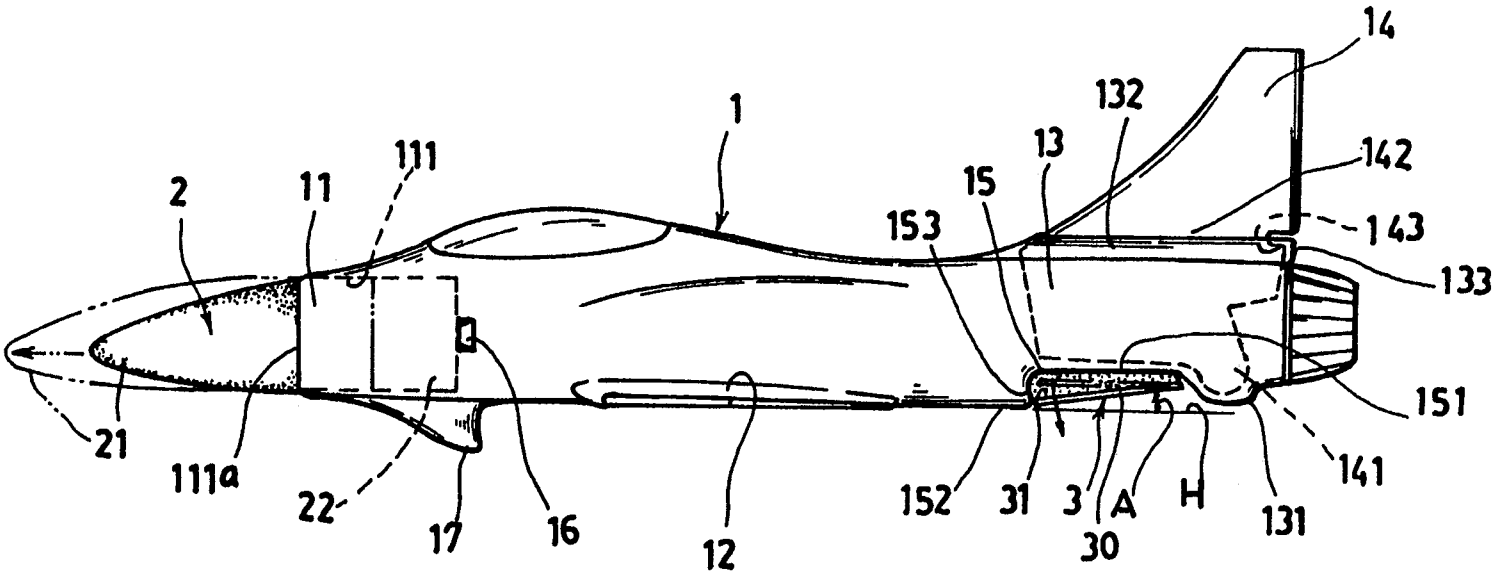
FIG. 1 is a front view showing a toy glider of the present invention.
Figure 1A:
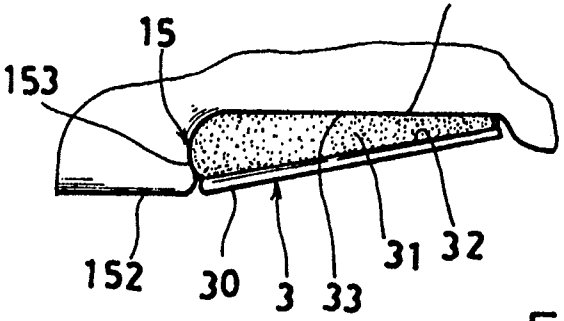
FIG. 1*a* shows a self-biasing elevator mounted on a tail portion of the present invention.

As shown in FIGS. 1–2, the present invention comprises: a fuselage 1, a telescopic nose member 2 telescopically secured in a front portion of the fuselage 1, and a self-biasing elevator 3 attached to a tail portion of the fuselage 1.

The fuselage 1 includes: a front portion 11 having a front cylindrical socket 111 recessed rearwardly from a front edge 111*a* of the front portion 11, a pair of wings 12 disposed on two opposite sides of the fuselage 1, or a delta wing (not shown) secured to the fuselage 1, a vertical stabilizer 14 secured on a tail portion 13 of the fuselage 1, a rear notch 15 recessed in a rear bottom portion of the tail portion 13 of the fuselage 1, at least a stopper 16 (or a pair of stoppers) protruding inwardly from a circumference of the front portion 11 of the fuselage 1 for limiting a rearward insertion of the telescopic nose member 2 when secured in the front portion 11 of the fuselage 1, and a catapulting hook portion 17 formed on a front bottom portion of the fuselage 1 to be catapulted for launching the toy glider of the present invention such as to be tensioned by an elastic rubber band or the like (not shown). The fuselage 1may be made as a hollow body.

The vertical stabilizer 14 includes: a bottom extension 141 protruding rearwardly downwardly to be engaged with a bottom socket 131 recessed deeply in a rear bottom end portion of the tail portion 13 of the fuselage 1, a fin portion 142 protruding upwardly from the bottom extension 141 to be held in a tail clip 132 formed on a rear upper portion of the tail portion 13, and a rear lug 143 protruding rearwardly from the fin portion 142 to be engaged with a rear socket 133recessed in a rear end portion of the tail clip 132 of the tail portion 13. The vertical stabilizer 14 will then be firmly secured in the tail portion 13 as retained in the tail clip 132, the bottom socket 131 and the rear socket 133.

The rear notch 15 includes: a horizontal notch surface 151, and an arcuate end surface 153 generally perpendicular to the horizontal notch surface 151 and perpendicular to a rear bottom portion 152 generally parallel to a horizontal plane H, with the rear notch 15 having a cross section of generally triangular or sector shaped.

The telescopic nose member 2 may be made of elastomer or foam materials, but not limited in this invention, and includes: a tapered nose portion 21 tapered forwardly, and a rear cylindrical portion 22 formed on a rear portion of the nose member 2 and telescopically inserted in the front cylindrical socket 111 in the front portion 11 of the fuselage 1, the rear cylindrical portion 22 having a diameter slightly larger than an inside diameter of the front cylindrical socket 111 of the fuselage 1 for a frictional holding of the rear cylindrical portion 22 of the nose member 2 in the front cylindrical socket 111 in the fuselage.

The nose member 2 can be telescopically secured in the front portion 11 of the fuselage beyond a front edge 111*a* of the front socket 111. For example, the nose member 2 can be extended outwardly or forwardly towards a dotted line as shown in FIGS. 1 and 2 to move a gravity center forwardly to adjust a flying path, such as a rotating radius as shown in FIG. 5.

Figure 5:
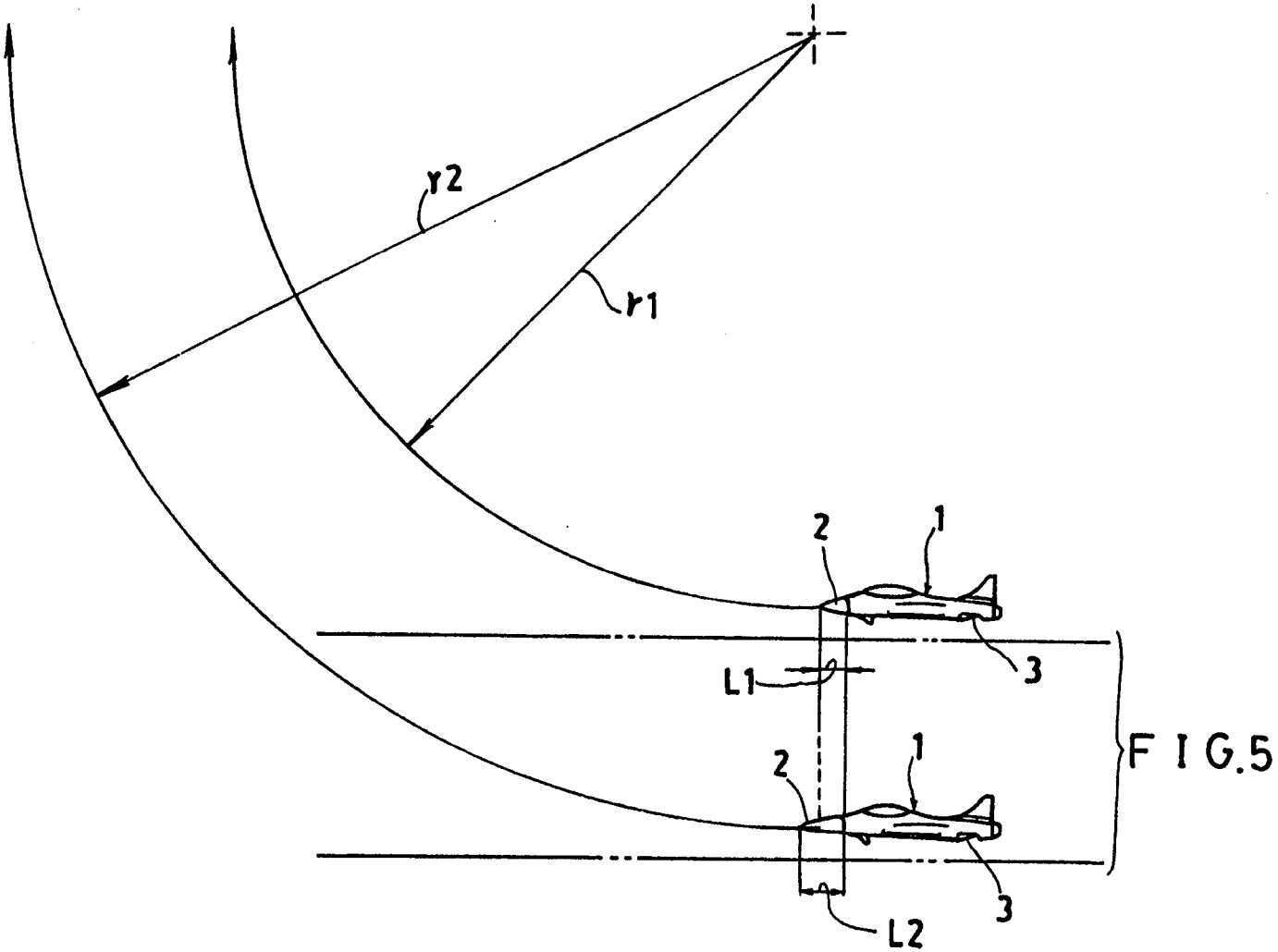
FIG. 5 shows two flying paths effected by two different nose-extended gliders in accordance with the present invention.

As shown in FIG. 5, a shortly-extended nose member 2 such as a short nose length L1 of the glider may be launched to spin in a first curvature C1 of smaller radius r1; while a longer nose length L2 of the nose member 2 may spin in a second curvature C2 with larger radius r2. Therefore, the nose member 2 can be either extended outwardly from the front socket 111 of the fuselage or be inserted inwardly into the socket 111 to adjust its extending length and to adjust a center of gravity of the fuselage, thereby varying a flying radius when catapulting the glider at the hook portion 17 to spur a player's interest.

Figure 3:
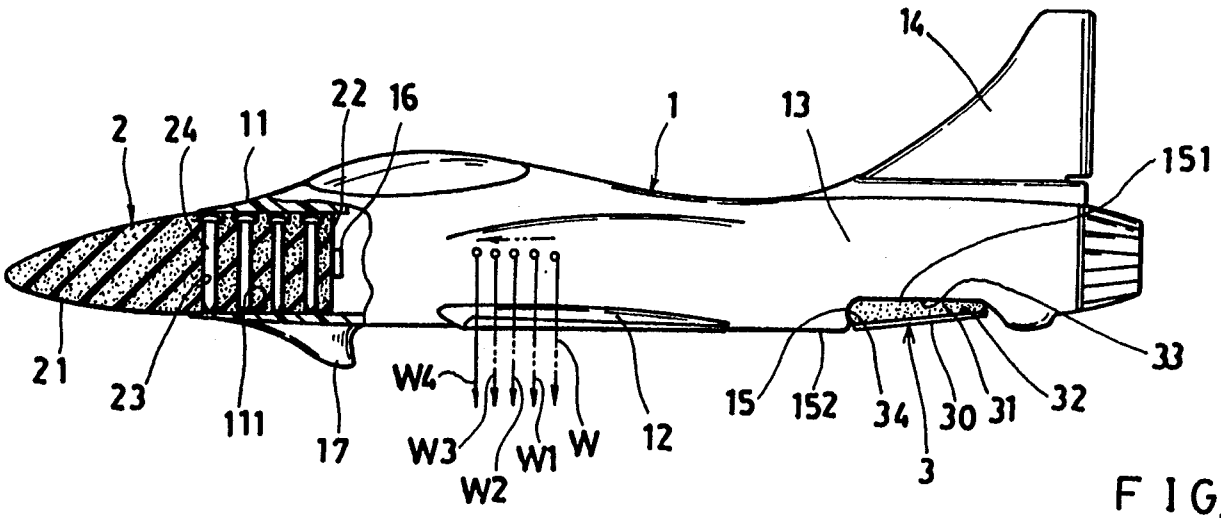
FIG. 3 is a partial sectional drawing of another preferred embodiment of a glider of the present invention.

The center of gravity of the fuselage may be adjusted from an original gavity center W to the other locations such as W1, W2, W3, W4 as shown in FIG. 3 by selectively adding one or plural counterweight latches 24 which are respectively inserted in a plurality of latch holes 23 juxtapositionally drilled in the rear cylindrical portion 22 of the nose member 2. The number of counterweight latches 24 can be optionally or selectively chosen by the player to adjust a gravity center of the glider to vary its flying paths.

Figure 4:
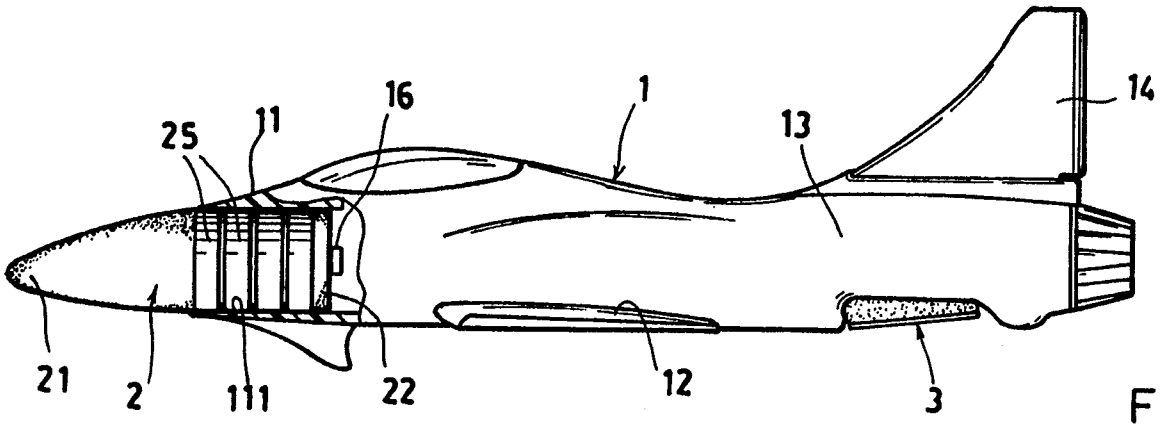
FIG. 4 is a partial sectional drawing of still another preferred embodiment of the present invention.

As shown in FIG. 4, the aforementioned counterweight latches 24 can be replaced with flexible counterweight bands 25 each band 25 fastened on the rear cylindrical portion 22 of the nose member 2 to adjust its weight and adjust the gravity center of the fuselage 1 in order to very flying paths such as a rotating radius when circularly launched or soaring.

The counterweights 24, 25 as shown in FIGS. 3, 4 may macroscopically adjust the gravity center of the glider in comparison with a microscopically adjusting of the gravity center just by telescopically extending or retracting the nose portion 2 from or in the glider as shown in FIG. 1.

Figures 6, 7:
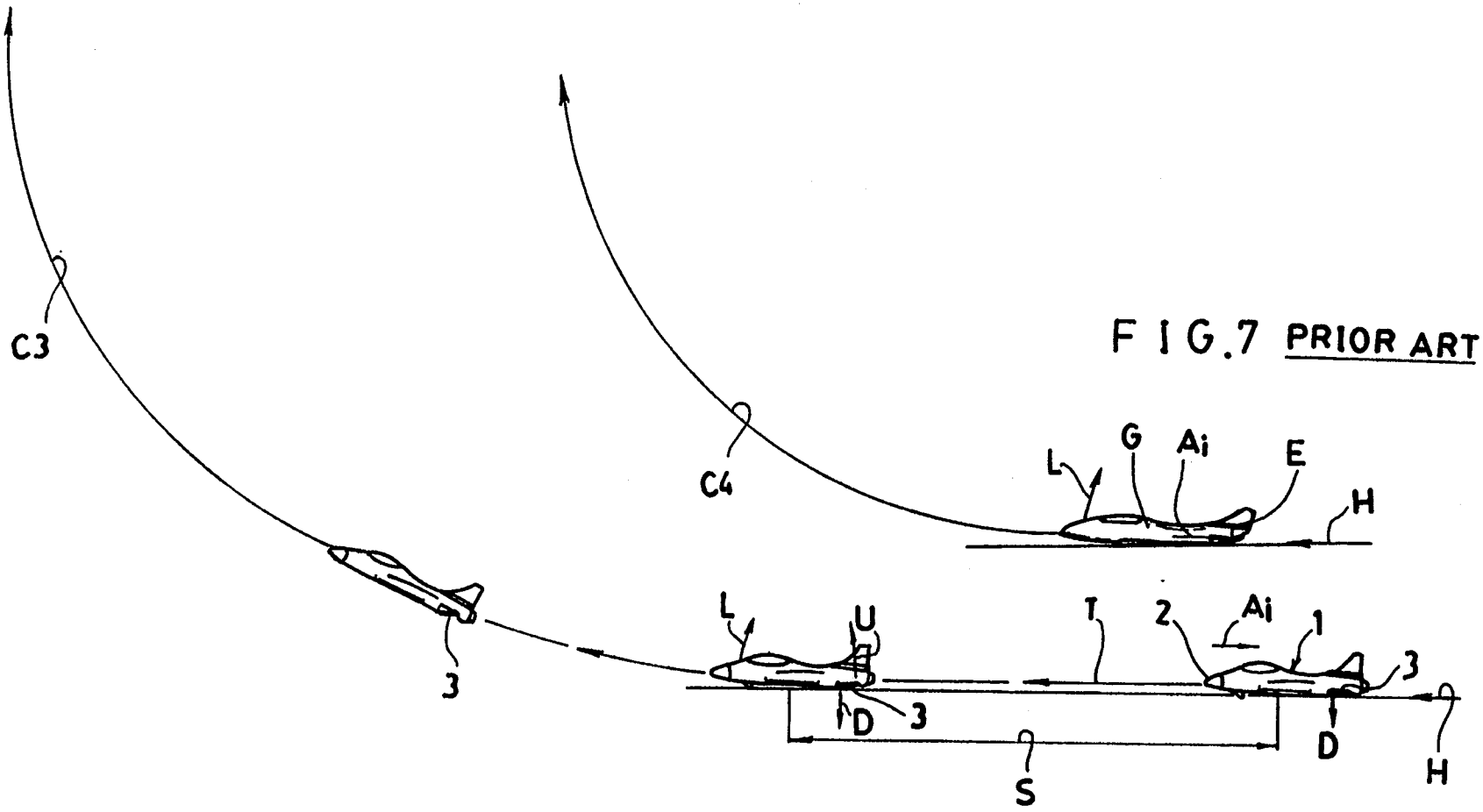
FIG.7 PRIOR ART
FIG. 6 shows an automatic conversion from a horizontal flying to a climbing launching of the glider in accordance with the present invention.
FIG. 7 shows a climbing launching of a conventional toy glider with its elevator having a fixed elevating angle.

The self-biasing elevator 3 includes: a tailplane 30 having its central upper surface secured to a restoring member 31 made of elastomer or foam which can be automatically expansible after releasing a compression force acting thereon, with the restoring member 31 being expansible to have a cross section generally triangular or sector shaped and engaging the rear notch 15 recessed in a rear bottom portion of the tail portion 13 of the fuselage 1, with the restoring member 31 being expansible to have a lower hypotenuse side 32 of the restoring member 31 secured with the tailplane 30 of the elevator 3 and tangential to the rear bottom portion 152 of the fuselage, an upper horizontal side 33 secured to the horizontal notch surface 151 of the rear notch 15, and an arcuate end portion 34 transversely connecting the lower hypotenuse side 32 and the upper horizontal side 33 and engaging with the arcuate end surface 153 of the rear notch 15, whereby upon a squeezing or compressing of the restoring member 31 towards the horizontal notch surface 151 of the rear notch 15, the tailplane 30 of the elevator 3 will be horizontally positioned for a horizontal flying when horizontally launched or catapulted (T), as shown in FIG. 6, by initially depressing the elastomer restoring member 31 towards the horizontal notch surface 151. The glider of the present invention will simulate a take-off of a real airplane from a horizontal sliding movement S, then climbing upwardly C3 as shown in FIG. 6. Since the elevator 3 will be automatically biased by an automatic expansion of the elastomer restoring member 31 to lower (D) the front edge of the tailplane 30 and simultaneously raise (U) the rear edge of the plane 30, thereby upwardly pitching or lifing (L) the fuselage 1 to climb upwardly (C3) when subjected to a wind or air flow Ai.

Comparatively, a conventional glider G as shown in FIG. 7 with fixed elevating angle E will be immediately launched upwardly (C4), unable to have a horizontal sliding movement to simulate a take-up of a real airplane and thereby easily decreasing a player's interest.

I claim:

1. A toy glider comprising:

a fuselage (1) including a pair of wings (12) secured to a middle portion of the fuselage (1), a vertical stabilizer (14) mounted on a tail portion of the fuselage (1), and a front socket recessed in a front portion of the fuselage (1);

a telescopic nose member (12) telescopically secured in said front socket of said fuselage (1) for adjusting a center of gravity of said fuselage (1) for varying a flying path of the toy glider; and a self-biasing elevator (3) including a tailplane (30) resiliently secured to a rear bottom portion (152) of said fuselage (1) by a restoring member (31), whereby upon a depression of the tailplane (30) and said restoring member (31) to horizontally position the tailplane (30), a horizontal flying of the toy glider can be catapulted, and upon releasing of the depression on the restoring member (31) after catapulting the glider, the restoring member (31) will automatically restore to bias the tailplane (30) for an elevating angle of the elevator (3) for upwardly pitching the glider for an upwardly climbing of the glider after a horizontal flying.

2. A toy glider according to claim 1, wherein said fuselage (1) includes: said front portion (11) having a front cylindrical socket (111) recessed rearwardly from a front edge (111*a*) of the front portion (11), said pair of wings (12) disposed on two opposite sides of the fuselage (1), said vertical stabilizer detachably secured on the tail portion (13) of the fuselage (1), a rear notch (15) recessed in a rear bottom portion of the tail portion (13) of the fuselage (1) for securing the restoring member (31) therein, at least a stopper (16) protruding inwardly from a circumference of the front portion (11) of the fuselage (1) for limiting a rearward insertion of the telescopic nose member (2) when secured in the front portion (11) of the fuselage (1), and a catapulting hook portion (17) formed on a front bottom portion of the fuselage (1) to be catapulted for launching the toy glider.

3. A toy glider according to claim 1, wherein said vertical stabilizer (14) includes: a bottom extension (141) protruding rearwardly downwardly to be engaged with a bottom socket (131) recessed deeply in a rear bottom end portion of the tail portion (13) of the fuselage (1), a fin portion (142) protruding upwardly from the bottom extension (141) to be held in a tail clip (132) formed on a rear upper portion of the tail portion (13), and a rear lug (143) protruding rearwardly from the fin portion (142) to be engaged with a rear socket (133) recessed in a rear end portion of the tail clip (32) of the tail portion (13).

4. A toy glider according to claim 2, wherein said rear notch (15) including: a horizontal notch surface (51), and an arcuate end surface (153) generally perpendicular to the horizontal notch surface (151) and perpendicular to a rear bottom portion (152), with the rear notch (15) having a cross section of generally triangular shaped, said rear notch (15) engageably secured with said restoring member (31) of said self-biasing elevator (3).

5. A toy glider according to claim 1, wherein said telescopic nose member (2) is made of elastomer materials, and includes: a tapered nose portion (21) tapered forwardly, and a rear cylindrical portion (22) formed on a rear portion of the tapered nose portion (21) and telescopically inserted in said front cylindrical socket (111) in the front portion (11) of the fuselage (1), the rear cylindrical portion (22) having a diameter slightly larger than an inside diameter of the front cylindrical socket (111) of the fuselage (1) for a frictional holding of the rear cylindrical portion (22) of the nose member (2) in the front cylindrical socket (111) in the fuselage.

6. A toy glider according to claim 5, wherein said telescopic nose member (2) includes: a plurality of counterweight latches (24) respectively inserted in a plurality of latch holes (23) juxtapositionally drilled in the rear cylindrical portion (22) of the nose member (2), said plurality of said counterweight latches (24) optionally chosen to adjust a gravity center of the toy glider to vary a flying path of the toy glider.

7. A toy glider according to claim 5, wherein said telescopic nose member (2) includes a plurality of counterweight bands (25) each said band (25) fastened on the rear cylindrical portion (22) of the nose member (2) to adjust a weight of the nose member to adjust the gravity center of the fuselage (1) in order to vary a flying path of the glider.

8. A toy glider according to claim 4, wherein said self-biasing elevator (3) includes said tailplane (30) having a central upper surface of said tailplane (30) secured to said restoring member (31) made of elastomer automatically expansible after releasing a compression force acting thereon, with the restoring member (31) expansible to have a cross section generally triangular shaped and engageable with the rear notch (15) recessed in the rear bottom portion of the tail portion (13) of the fuselage (1), with the restoring member (31) being expansible to have a lower hypotenuse side (32) of the restoring member (31) secured with the tailplane (30) of the elevator (3) and tangential to the rear bottom portion (152) of the fuselage, an upper horizontal side (33) secured to the horizontal notch surface (151) of the rear notch (15), and an arcuate end portion (34) transversely connecting the lower hypotenuse side (32) and the upper horizontal side (33) and engaging with the arcuate end surface (153) of the rear notch (15), whereby upon a squeezing of the restoring member (31) towards the horizontal notch surface (151) of the rear notch (15), the tailplane (30) of the elevator (3) will be horizontally positioned for a horizontal flight when initially horizontally catapulted.

* * * * *